US005211720A

United States Patent [19]

Johnson

[11] Patent Number: 5,211,720

[45] **Date of Patent: * May 18, 1993**

[54] DYEING AND FLAME-RETARDANT TREATMENT FOR SYNTHETIC TEXTILES

[75] Inventor: James R. Johnson, McLeansville, N.C.

[73] Assignee: Burlington Industries, Inc., Greensboro, N.C.

[ * ] Notice: The portion of the term of this patent subsequent to Feb. 20, 2007 has been disclaimed.

[21] Appl. No.: 208,914

[22] Filed: Jun. 20, 1988

Related U.S. Application Data

[63] Continuation-in-part of Ser. No. 871,389, Jun. 6, 1986, Pat. No. 4,752,300.

[51] Int. Cl.[5] ..... D06M 9/00; C09B 67/00

[52] U.S. Cl. ..... 8/584; 8/115.51; 8/127.1; 8/531; 8/534; 8/633; 8/DIG. 4; 8/DIG. 21; 8/129; 106/18.18; 57/904; 427/393.3

[58] Field of Search ..... 8/584, 574, 127.1, 490; 106/18.18; 427/393.3, 352; 428/229; 252/608

[56] References Cited

U.S. PATENT DOCUMENTS

| | | | |
|---|---|---|---|
| 3,511,857 | 5/1970 | Baranauckas et al. | 260/347.8 |
| 3,527,557 | 9/1970 | Cheape | 8/100 |
| 3,565,572 | 2/1971 | Schneider et al. | 8/171 |
| 3,669,610 | 6/1972 | Friedman | 8/128 |
| 3,729,340 | 4/1973 | Powell | 117/136 |
| 3,749,599 | 7/1973 | Bergman | 117/136 |
| 3,749,600 | 7/1973 | Bergman et al. | 117/136 |
| 3,758,335 | 9/1973 | Bergman | 117/136 |
| 3,789,091 | 1/1974 | Anderson et al. | 260/927 R |
| 3,803,271 | 4/1974 | Chiddix et al. | 260/956 |
| 3,816,072 | 6/1974 | Bergman et al. | 173/21 |
| 3,849,368 | 11/1974 | Anderson et al. | 260/45.8 R |
| 3,856,535 | 12/1974 | Ferguson | 106/15 FP |
| 3,859,124 | 1/1975 | Thompson | 117/136 |
| 3,864,077 | 2/1975 | Popp et al. | 173/174 |
| 3,950,129 | 4/1976 | Friedman et al. | 8/17 |
| 3,991,019 | 11/1976 | Shim | 260/2.5 AJ |
| 4,054,720 | 10/1977 | Tomita et al. | 428/480 |
| 4,055,689 | 10/1977 | Nachbur et al. | 427/379 |
| 4,066,812 | 1/1978 | Kaupin | 428/265 |
| 4,113,429 | 9/1978 | Kruse et al. | 8/90 |
| 4,134,052 | 2/1982 | Engelhardt et al. | 528/287 |
| 4,139,476 | 2/1979 | Hancock | 252/8.1 |
| 4,237,157 | 12/1980 | Hancock | 252/8.1 |
| 4,397,759 | 8/1983 | Hancock | 252/609 |
| 4,752,300 | 6/1988 | Johnson | 8/584 |
| 4,814,222 | 3/1989 | Davis et al. | 8/584 |
| 4,902,300 | 2/1990 | Johnson et al. | 8/532 |

FOREIGN PATENT DOCUMENTS

| | | |
|---|---|---|
| 0246083 | 11/1987 | European Pat. Off. . |
| 0246084 | 11/1987 | European Pat. Off. . |
| 1381016 | 1/1975 | United Kingdom . |
| 1531830 | 11/1978 | United Kingdom . |

OTHER PUBLICATIONS

Chemical Abstracts, vol. 98, No. 26, Jun. 1983, p. 81, Abstract no. 217132c.

Chemical Abstracts, vol. 83, No. 26, Dec. 1975, p. 71 Abstract no. 207491v.

Mobil Corporation Product Brochure, Antiblaze 19 Data Sheet.

Mobil Chemical product information bulletin, Antiblaze 19 Flame Retardant and Antiblaze 19T Flame Retardant.

*Primary Examiner*—Prince Willis, Jr.
*Assistant Examiner*—John F. McNally
*Attorney, Agent, or Firm*—Nixon & Vanderhye

[57] ABSTRACT

Thermoplastic fabrics are flame retardant treated and optionally heatset and/or simultaneously dyed in a heated flame retardant liquid in which a disperse or acid dye may be dissolved. Flame-resistant fabrics result.

13 Claims, No Drawings

DYEING AND FLAME-RETARDANT TREATMENT FOR SYNTHETIC TEXTILES

CROSS-REFERENCE TO RELATED APPLICATIONS

This application is a continuation-in-part of earlier application Ser. No. 871,389 filed Jun. 6, 1986, now U.S. Pat. No. 4,752,300.

BACKGROUND OF THE INVENTION

This invention relates to an improved process of treating fabrics constructed of synthetic thermoplastic fibers to impart flame resistance and is specific to the use of cyclic phosphonate esters having flame retardant properties. Also described are procedures in which flame resistance is imparted to the fabric and the fabric is heatset, dyed or both heatset and dyed in the same procedure. These esters serve to swell the thermoplastic fiber and allow introduction of a dyestuff into the fiber.

For certain applications and end uses, many fabrics and composites must meet specific flammability standards. To meet these standards, it is sometimes necessary to apply flame retardant chemicals. Cyclic phosphonate esters are a known class of flame retardants used for treating textiles and plastics. The supplier recommends diluting these flame retardant materials with up to about 90% of water and applying the resulting solution by padding in a pad bath followed by drying then heating in an oven at temperatures up to 420° F.

This invention uses flame retardants that withstand elevated temperatures and are liquids at elevated temperatures. The flame retardant is used in "neat", undiluted or substantially undiluted form. When dyeing is also desired, a suitable dye is dissolved in the flame retardant to simultaneously dye and flame retardant treat the synthetic thermoplastic fibers.

The elevated temperatures used in the flame retarding process are also effective temperatures to heatset the fabric. This is easily accomplished when the fabric is kept under the appropriate tension as the fabric is exposed to the operational temperatures used to impart flame resistance to the fabric. In another embodiment, this invention simultaneously flame retardant treats and dyes thermoplastic fibers in a dyebath containing only the flame retardant and a dissolved disperse and/or anionic dye. Brief immersion of the fabric to be dyed into a heated bath causes the cyclic ester flame retardant and the dye to diffuse into the thermoplastic fibers. Time and temperature requirements are easily determined by a short series of examples. With proper tension controls, the fibers in fabric form can be dyed flame retardant treated and heatset in the same operation. Excess liquid on the fabric surface is conveniently removed by vacuum or other means and returned to the bath. Remaining liquid on the fabric is removed by scouring; the scoured fabric can be dried, for example in a tenter oven where tension is easily controlled.

In addition to the dyestuff(s), the treatment bath or liquid may also include other finishing chemicals and processing adjuvants amenable to application by such a process, including UV stabilizers, antistats, soil release agents, and the like.

It is therefore an object of this invention to both dye and flame retardant treat synthetic thermoplastic fibers, excluding the simultaneously flame retardant treating and dyeing of polyaramid fibers which is the subject of copending application Ser. No. 871,389, now U.S. Pat. No. 4,752,300, identified above, in a single step and to provide a dyed product that has flame resistant qualities. Candidate thermoplastic fibers include nylon, high-tenacity nylon, polyester, acetates and acrylic fibers.

It is also an object of this invention to simultaneously flame retardant treat and heatset fabrics made of synthetic thermoplastic fibers.

Another object of this invention is to simultaneously flame retardant treat and dye fabrics made of synethetic thermoplastic fibers.

Another object of this invention is to simultaneously flame retardant treat, dye and heatset fabrics made of synthetic thermoplastic fibers.

These and other attributes of the invention are realized from the detailed disclosure that follows.

DETAILED DESCRIPTION OF THE INVENTION

This invention includes the application of a flame retardant material or flame retardant system at elevated temperatures in liquid form optionally together with a disperse dye or an acid dye (anionic dye) to a thermoplastic fiber in the form of staple, tow, or yarn; woven, non-woven, circular knitted, or tricot knitted fabric; crimped, texturized, flocked, or tufted textile; but preferably in the form of a woven fabric. An acid or disperse dye, when dissolved or dispersed in the liquid flame retardant, may be applied to the fibers using any convenient process; however (1) a pad/thermosol process, (2) a print paste process; or (3) immersion of the fibers into a neat, heated solution of flame retardant plus dyestuff gives the best results.

The flame retardant materials used in the process of this invention do not degrade and successfully withstand heat treatment at temperatures over 300° F., and are typically liquid at such temperatures. The process of this invention is conventiently conducted at elevated temperatures. Among the types of flame retardant materials that may be employed, preferred are the cyclic phosphonate esters described, for instance, in one or more of U.S. Pat. Nos. 3,894,386; 3,149,476; 3,991,019; and 3,511,857.

The flame retardant materials used in accordance with the present invention are thermally stable cyclic phosphonate esters prepared by reacting alkyl halogen-free esters with a bicyclic phosphite. As a class these cyclic phosphonate esters are represented by one of the formulas:

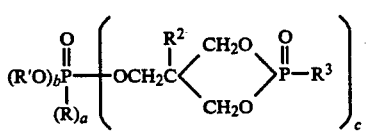

(A)

where a is 0 or 1; b is 0, 1 or 2; c is 1, 2 or 3 and a+b+c is 3; R and R′ are the same or different and are alkyl ($C_1$–$C_8$), phenyl, halophenyl, hydroxyphenyl, tolyl, xylyl, benzyl, phenethyl, hydroxyethyl, phenoxyethyl, or dibromophenoxymethyl; $R^2$ is alkyl ($C_1$–$C_4$); and $R^3$ is lower alkyl ($C_1$–$C_4$) or

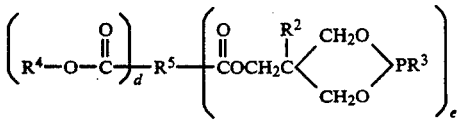

(B)

where d is 0, 1 or 2; e is 1, 2 or 3; $R^2$ is alkyl ($C_1$–$C_4$); $R^3$ is lower alkyl ($C_1$–$C_4$) or hydroxyalkyl ($C_1$–$C_4$); $R^4$ is alkyl ($C_1$–$C_4$) phenyl, halophenyl, hydroxyphenyl, hydroxyethyl, phenoxyethyl, dibromophenoxyethyl, tolyl, xylyl, benzyl, or phenethyl; and $R^5$ is monovalent alkyl ($C_1$–$C_6$), chlorophenyl, bromophenyl, dibromophenyl, tribromophenyl, hydroxyphenyl, naphthyl, tolyl, xylyl, benzyl, or phenethyl; divalent alkylene ($C_1$–$C_6$), vinylene, o-phenylene, m-phenylene, p-phenylene, tetrachlorophenylene (o, m, or p), or tetrabromophenylene (o, m, or p); or trivalent phenenyl.

The preferred compounds are represented by the formula:

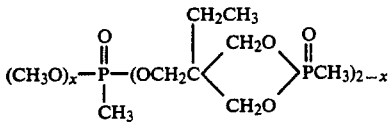

(C)

in which x is 0 or 1, usually 50:50 mixture of the mono and di-esters. The preparation of these cyclic phosphonate esters and their use as flame retardants are described in U.S. Pat. Nos. 3,789,091 and 3,849,368, the disclosures of which are hereby incorporated by reference.

The 50:50 mixture of these esters is available as Antiblaze 19 (sometimes AB 19 herein) from Albright & Wilson, Inc., of Richmond, Va. Also available is Antiblaze 19T, a low viscosity grade flame retardant containing 93% active ingredient formulated especially for textile treating requirements. As described by the supplier, Antiblaze 19 has a flash point of 464° F. (240° C.) by the Cleveland open cup method and is suited for application at high temperature.

An essential part of the present invention is heating the fibers, optionally in the presence of the dyestuff (disperse or acidic) dissolved in the flame retardant liquid. Treatment temperatures in the range of about 300° to as high as about 600° F. are contemplated. However, higher and lower temperatures may be employed depending upon the specific heat characteristics and tolerance of the thermoplastic fiber being treated, heat tolerance of the dyestuff itself, and the nature of the flame retardant liquid. Experience with a particular flame retardant will indicate the appropriate temperature or temperature range for the fabric being treated. Heating is generally in the range of about 350° to about 390° F. and for a period of time sufficient to impart the desired flame retardant characteristics to the fiber as well as to introduce a sufficient quantity of dyestuff into the fiber when the fiber is to be simultaneously dyed. At these operational temperatures, the synthetic thermoplastic fibers are readily heatset, if desired, when held under tension. Exposure times range from periods as short as 10 seconds up to 2 minutes or longer, depending upon the processing conditions and the equipment employed.

Treating compositions, dyestuff-containing compositions and flame-retardant treatments are detailed below.

The pad/thermosol process. A solution of "neat" (undiluted) flame retardant optionally containing the desired quantity of disperse or acid dye is padded onto the fabric which is then heat treated in order to "fix" the dyestuff to the fiber and provide the required flame-retardant properties. Following this, the fabric is washed with an aqueous detergent (scoured) and then dried.

Print pastes. A paste of disperse dyestuff is made with the liquid flame-retardant material, and this is then applied to the fabrics to be treated either in a uniform manner, such as with a doctor knife, nip roll or the like, or in a predetermined pattern on a printing machine. Heat is applied in order to fix the dyestuff to the fibers and accomplish the required flame retardant treatment, and this is followed by an aqueous detergent scour and drying.

Immersion in hot fluid. Successful flame retardant treatment alone or with heatsetting, dyeing or both heatsetting and dyeing may be accomplished by immersing the fibers, typically in fabric form, into a bath containing the flame retardant material in which the requisite quantity of disperse or acid dye has been dissolved. When Antiblaze 19 is used as the flame retardant liquid, the liquid is maintained at a temperature in the range of about 350° to about 380° F., and the fibers are exposed to the heated liquid for various periods of time ranging from as little as 15 seconds up to about 2 minutes. This immersion is followed by an aqueous detergent scour and then drying.

While not wishing to be bound by any theory or mode of operation, it would appear that a suitable flame retardant acts both as a solvent or a vehicle for dyeing the fiber and causing the fiber itself to swell, thus allowing the disperse or acid dye to enter into the fibers together with the flame retardant itself. In addition, it appears that the dyeing mechanism is an equilibrium condition between the fiber and the flame-retardant fluid—the greater the solubility of the dye in the flame-retardant liquid, the less the "solubility" of the dye in the fiber.

The process of the present invention makes it possible to both dye and improve the flame resistant characteristics of thermoplastic fibers using either acid dyes or disperse dyes with the minimum number of steps, at a rapid rate of treatment and on existing equipment. The dyes can be applied by a pad/thermosol process, immersion in the hot flame-retardant fluid containing the dye, or by incorporating the flame-retardant fluid into a print paste and printing the fabric, as detailed above.

Flame Retardancy Tests

The processes of the present invention are capable of imparting desirable flame-retardant properties to the material being treated so that the fabric will at least meet the standards established by the requisite review or governmental authority. A host of such tests are given in U.S. Pat. No. 4,120,798, as well as test methods ASTM Method D-2863-77; FTM 5903; and FTM 5905.

Flame resistance testing procedures and methods are explained in more detail below. From these tests to will be apparent that the simultaneous dyeing and flame-retardant treatment of the present invention improves the burning characteristics of thermoplastic fibers. In addition, the finish is durable.

ER Federal Test Method 5903 is intended for use in determining the resistance of cloth to flame and glow propagation and tendency to char. A rectangular cloth test specimen (70 mm×120 mm) with long dimension parallel to the warp or fill direction is placed in a holder and suspended vertically in a cabinet with the lower end 3/4 inch above the top of a Fisher gas burner. A synthetic gas mixture consisting primarily of hydrogen and methane is supplied to the burner. After the specimen is mounted in the cabinet and the door closed, the burner flame is applied vertically at the middle of the lower edge of the specimen for 12 seconds. The specimen continues to flame after the burner is extinguished. The time in seconds the specimen continues to glow after the specimen has ceased to flame is reported as afterglow time; if the specimen glows for more than 30 seconds, it is removed from the test cabinet, taking care not to fan the flame, and suspended in a draft-free area in the same vertical position as in the test cabinet. Char length, the distance from the end of the specimen which was exposed to the flame, to the end of a lengthwise tear through the center of the charred area to the highest peak in the charred area, is also measured and the results averaged.

FR Federal Test Method 5905, a flame contact test, is a measurement of the resistance of textiles and other materials to flame propagation that exposes the specimen to the flame source for a longer period of time than test method 5903. A test specimen the same size as in the above method is exposed to a high temperature butane gas flame 3 inches in height by vertical suspension in the flame for 12 seconds, the lowest part of the specimen always 1.5 inches above the center of the burner. At the end of 12 seconds, the specimen is withdrawn from the flame slowly, and any afterflaming timed. The specimen is then re-introduced into the flame and again slowly withdrawn after 12 seconds and any afterflame timed. For each 12-second exposure the results are reported as: ignites, propagates flame; ignites but is self-extinguishing; is ignition resistant; melts; shrinks away from the flame; or drops flaming pieces.

Limiting Oxygen Index (LOI) is a method of measuring the minimum oxygen concentration needed to support candle-like combustion of a sample according to ASTM D-2863-77. A test specimen is placed vertically in a glass cylinder, ignited, and a mixture of oxygen and nitrogen is flowed upwardly through the column. An initial oxygen concentration is selected, the specimen ignited from the top and the length of burning and the time are noted. The oxygen concentration is adjusted, the specimen is re-ignited (or a new specimen inserted), and the test is repeated until the lowest concentration of oxygen needed to support burning is reached.

The invention will be further explained with reference to the following examples in which all parts and percentages are by weight and temperatures reported in degrees Fahrenheit.

EXAMPLES

Samples of Suraline textured polyester woven fabric weighing 8.0 oz./sq.yd. were padded with either neat Antiblaze 19T or a 1% (w/w.) solution of Disperse Blue 56 dye in Antiblaze 19T. The samples were then heated in a laboratory oven under the conditions shown below:

| Sample Code | Padding Solution | Wet Pickup (%) | Temp (°F.) | Time (Sec) |
|---|---|---|---|---|
| 0 | — | — | — | — |
| 2A | AB-19T | 109 | 370 | 90 |

-continued

| Sample Code | Padding Solution | Wet Pickup (%) | Temp (°F.) | Time (Sec) |
|---|---|---|---|---|
| 2B | AB-19T | 131 | 400 | 60 |
| 3A | AB-19T + Dye | 159 | 340 | 30 |
| 3B | AB-19T + Dye | 153 | 340 | 60 |
| 3C | AB-19T + Dye | 155 | 340 | 90 |
| 4A | AB-19T + Dye | 153 | 370 | 30 |
| 4B | AB-19T + Dye | 130 | 370 | 60 |
| 4C | AB-19T + Dye | 152 | 370 | 90 |
| 5C | AB-19T + Dye | 152 | 400 | 30 |
| 5B | AB-19T + Dye | 146 | 400 | 60 |
| 5C | AB-19T + Dye | 152 | 400 | 90 |

The sample were rinsed several times in cool water to remove excess Antiblaze 19T, then air-dried. A portion of each sample was home-laundered ten times, using warm (120° F.) water and Orvus detergent.

The samples which had been treated with dye solution were blue. The depth of shade increased both with oven temperature and with treatment time. The color was fast to laundering, being changed only a minor amount after the ten launderings.

Samples of the fabrics were tested for flame resistance by FTM 5903. The untreated control (Sample 0) had char length of 4.1 inches, with 19 seconds afterflame and some flaming melt-drip on one specimen. After laundering, average char length was 4.6 inches, afterflames were 2 and 15 seconds and one specimen had minor flaming melt-drip. The sample treated under the mildest conditions (Sample 3A) had char length of 4.1 inches with afterflames of 8 and 20 seconds, but no flaming melt-drip. After laundering, char length was 4.1 inches but there were no afterflames or flaming melt-drip. None of the other treated samples exhibit afterflame or flaming melt-drip, either before or after laundering. Char lengths ranged between 3.0 and 4.5 inches. These results indicate that the treatment imparted a high degree of durable flame resistance to the polyester fabric.

Shrinkage of several samples was measured after ten home launderings.

| Sample Code | Shrinkage Warp | Shrinkage Filling |
|---|---|---|
| 0 | 3.7% | 1.2% |
| 2A | 1.5 | 0.9 |
| 2B | 2.3 | 1.7 |
| 4C | 2.2 | 1.9 |
| 5B | 1.6 | 1.7 |

These results indicate that a moderate degree of heat-setting was imparted by the treatments.

Phosphorus content of samples was measured by X-ray fluorescence.

| Sample Code | Phosphorus Content Original | Phosphorus Content Laundered |
|---|---|---|
| 0 | 0.0% | 0.0% |
| 3A | 0.02 | 0.02 |
| 3B | 0.26 | 0.20 |
| 3C | 0.37 | 0.33 |
| 4A | 0.13 | 0.06 |
| 4B | 0.53 | 0.51 |
| 4C | 0.72 | 0.67 |
| 5A | 0.32 | 0.20 |
| 5B | 0.93 | 0.87 |

-continued

| Sample Code | Phosphorus Content Original | Laundered |
|---|---|---|
| 5C | 1.03 | 1.02 |

These results show that the treatments have imparted phosphorus contents, durable to home laundering, to the polyester fabrics.

What is claimed is:

1. A process of simultaneously flame retardant treating and heatsetting a polyester fabric, comprising the steps of:

(1) contacting a polyester fabric with a liquid consisting essentially of a flame retarding amount of a cyclic phosphonate ester flame retardant represented by the formulae:

(A)

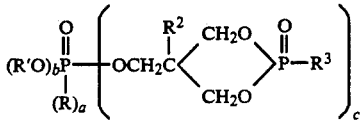

where a is 0 or 1; b is 0, 1 or 2; c is 1, 2 or 3 and a+b+c is 3; R and R' are the same or different and are alkyl ($C_1$-$C_8$), phenyl, halophenyl, hydroxyphenyl, tolyl, xylyl, benzyl, phenethyl, hydroxyethyl, phenoxyethyl, or dibromophenoxymethyl; $R^2$ is alkyl ($C_1$-$C_4$); and $R^3$ is lower alkyl ($C_1$-$C_4$) or hydroxyalkyl ($C_1$-$C_4$); or (B)

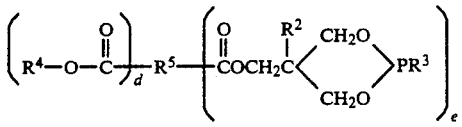

where d is 0, 1 or 2; e is 1, 2 or 3; $R^2$ is alkyl ($C_1$-$C_4$); $R^3$ is lower alkyl ($C_1$-$C_4$) or hydroxyalkyl ($C_1$-$C_4$); $R^4$ is alkyl ($C_1$-$C_4$), phenyl, halophenyl, hydroxyphenyl, hydroxyethyl, phenoxyethyl, dibromophenoxyethyl, tolyl, xylyl, benzyl, or phenethyl; and $R^5$ is monovalent alkly ($C_1$-$C_6$), chlorophenyl, bromophenyl, dibromophenyl, tribromophenyl, hydroxyphenyl, naphthyl, tolyl, xylyl, benzyl, or phenethyl; divalent alkylene ($C_1$-$C_6$), vinylene, o-phenylene, m-phenylene, p-phenylene, tetrachlorophenylene (o, m, or p), or tetrabromophenylene (o, m, or p); or trivalent phenenyl; at a temperature of at least 300° F.; and (2) heating the fabric treated in step (1) at a temperature of about 350° F. to about 600° F. while holding it under tension to simultaneously heatset and fix the flame retardant to said fabric.

2. The process of claim 1, in which the flame retardant liquid also contains a tinctorial amount of a disperse dye, an acid dye, or both, and the fabric is simultaneously flame retardant treated and dyed.

3. The process of claim 1, in which the flame retardant liquid also contains a tinctorial amount of a disperse dye, an acid dye, or both, the fabric is held under tension and the fabric is simultaneously flame retardant treated, dyed and heatset.

4. The process of claim 1, in which the treatment is conducted at a temperature of about 350° F. to about 400° F.

5. The process of claim 4, in which the fabric is heated for about 30 seconds to about 2 minutes.

6. The process of claim 1, in which the fabric is exposed to the flame retardant liquid for about 10 seconds to about 2 minutes.

7. A flame-retardant treated fabric produced by the process of claim 1.

8. A process of dyeing and imparting flame resistant characteristics to a fabric composed of dyeable polyester fibers, comprising the successive steps of:

(1) contacting the polyester fabric with a solution consisting essentially of a flame-retarding amount of a cyclic phosphonate ester flame retardant represented by the formulae:

(A)

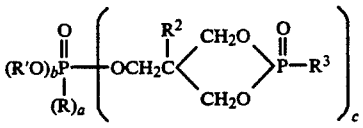

where a is 0 or 1; b is 0, 1 or 2; c is 1, 2 or 3 and a+b+c is 3; R and R' are the same or different and are alkyl ($C_1$-$C_8$), phenyl, halophenyl, hydroxyphenyl, tolyl, xylyl, benzyl, phenethyl, hydroxyethyl, phenoxyethyl, or dibromophenoxymethyl; $R^2$ is alkyl ($C_1$-$C_4$); and $R^3$ is lower alkyl ($C_1$-$C_4$) or hydroxyalkyl ($C_1$-$C_4$); or (B)

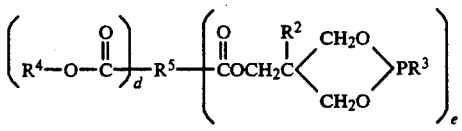

where d is 0, 1 or 2; e is 1, 2 or 3; $R^2$ is alkyl ($C_1$-$C_4$); $R^3$ is lower alkyl ($CH_1$-$C_4$) or hydroxyalkyl ($C_1$-$C_4$); $R^4$ is alkyl ($C_1$-$C_4$) phenyl, halophenyl, hydroxyphenyl, hydroxyethyl, phenoxyethyl, dibromophenoxyethyl, tolyl, xylyl, benzyl, or phenethyl; and $R^5$ is monovalent alkyl ($C_1$-$C_6$), chlorophenyl, bromophenyl, dibromophenyl, tribromophenyl, hydroxyphenyl, naphthyl, tolyl, xylyl, benzyl, or phenethyl; divalent alkylene ($C_1$-$C_6$), vinylene, o-phenylene, m-phenylene, p-phenylene, tetrachlorophenylene (o, m, or p), or tetrabromophenylene (o, m, or p); or trivalent phenenyl and a disperse dyestuff, an acid dyestuff or both dissolved or dispersed therein, the solution maintained at a temperature of from about 300° F. to a temperature not greater than the boiling point of the solution;

(2) allowing the fabric to remain in contact with the solution at a temperature of about 350° F. to about 600° F. until the dye and the flame retardant are fixed to the fiber; and (3) removing and drying the dyed and flame-retardant treated fabric.

9. The process of claim 8, in which the solution is maintained at a temperature in the range of about 350° F. to about 400° F.

10. The process of claim 8 or 9, in which the fiber is in contact with the heated solution for from about 15 seconds to about 2 minutes.

11. The process of claim 8 or 9, in which the fabric is held under tension and the resulting fabric is flame-retardant treated, dyed and heatset.

12. A dyed and flame-retardant treated polyester fiber or fabric produced by the process of claim 8.

13. A flame-retardant treated, dyed and heatset polyester fabric produced by the process of claim 11.

* * * * *